US006421839B1

(12) United States Patent
Vo et al.

(10) Patent No.: US 6,421,839 B1
(45) Date of Patent: Jul. 23, 2002

(54) WORK PANT WITH KNEELING CUSHIONING POCKET

(76) Inventors: Danny Van Vo, 20140 Acre St., Canoga Park, CA (US) 91306; Robert J. Warner, 312 Hickory Grove Dr., Newbury Park, CA (US) 91320

( * ) Notice: Subject to any disclaimer, the term of this patent is extended or adjusted under 35 U.S.C. 154(b) by 1 day.

(21) Appl. No.: 09/910,708

(22) Filed: Jul. 23, 2001

(51) Int. Cl.[7] ..... A41D 13/02
(52) U.S. Cl. ..... 2/227; 2/24
(58) Field of Search ..... 2/24, 243, 455, 2/456, 22, 23, 267, 247–252, 243.1, 79, 227

(56) References Cited

U.S. PATENT DOCUMENTS

| | | | |
|---|---|---|---|
| 514,576 | A | 2/1894 | Walther et al. |
| 588,907 | A | 8/1897 | Herbelin |
| 671,059 | A | 4/1901 | Sanders |
| 1,304,613 | A | 5/1919 | Smedley |
| 1,636,553 | A | 7/1927 | Cruden |
| 2,355,193 | A | 8/1944 | Walker |
| 2,501,111 | A | 3/1950 | Walker |
| 2,568,083 | A | 9/1951 | Mitchell |
| 3,168,746 | A | 2/1965 | Smith |
| 4,035,844 | A | 7/1977 | Atack et al. |
| D267,674 | S | 1/1983 | Liveroiis |
| 4,488,314 | A | 12/1984 | Johnson |
| 4,561,123 | A | 12/1985 | Hull |
| 4,561,124 | A | 12/1985 | Thompson |
| 4,613,991 | A | 9/1986 | Grover |
| 4,831,666 | A | 5/1989 | Denman |
| 4,870,956 | A | 10/1989 | Fatool et al. |
| 4,920,577 | A | 5/1990 | Scharf |
| 5,038,408 | A | 8/1991 | DeBaene |
| 5,050,244 | A | 9/1991 | Kleinman |
| 5,052,052 | A | 10/1991 | Gilford et al. |
| 5,054,127 | A | 10/1991 | Zevchak |
| 5,105,473 | A | 4/1992 | Valtakari |
| 5,134,726 | A | 8/1992 | Ross |
| 5,267,354 | A | 12/1993 | Grilliot et al. |
| 5,551,084 | A | 9/1996 | Freese, III |
| 5,611,081 | A | 3/1997 | Torres |
| D381,490 | S | 7/1997 | Torres |
| 5,720,045 | A | 2/1998 | Aldridge |
| 5,729,832 | A | 3/1998 | Grilliot et al. |
| 5,732,412 | A | 3/1998 | Holden |
| D393,141 | S | 4/1998 | Glycenfer |
| D395,939 | S | 7/1998 | DeFino |
| 5,845,333 | A | 12/1998 | Crampton |
| 5,896,580 | A | 4/1999 | Aldrich et al. |
| 6,014,771 | A | 1/2000 | Kirven |
| 6,049,906 | A | 1/2000 | Aldrich |

*Primary Examiner*—John J. Calvert
*Assistant Examiner*—Tejash Patel
(74) *Attorney, Agent, or Firm*—Jack C. Munro

(57) ABSTRACT

Pants which include at least one pant leg and a pocket in the area of the knee. Within each pocket is to be located a cushioning pad. The cushioning pad is to be inserted through an access opening which has a length smaller than the width of the knee pocket which tends to prevent accidental dislodgment of the pad from the knee pocket. A securement device is to be connectable between the pad and the pant leg of the work pant. The knee pocket may be covered by a covering sheet to hopefully prevent the forming of wear holes within the knee area of the work pant.

2 Claims, 3 Drawing Sheets

WORK PANT WITH KNEELING CUSHIONING POCKET

BACKGROUND OF THE INVENTION

1. Field of the Invention

The present invention relates generally to work pants that includes pockets within the knee area of the pants with a cushioning pad to be locatable within each knee pocket for providing comfort and injury protection for the user's knees when performing of work which requires kneeling on a hard surface.

2. Description of the Related Art

Work pants that include padded knee sections have long been used by workers to cushion and protect their knees when kneeling. Carpenters, roofers, floor installers and gardeners spend considerable time in a kneeling position, and for purposes of comfort and to prevent injury, require a cushioning protection for the user's knees. Without such protection, such tradesmen often find themselves unable to continue with the kneeling position over an extended length of time. For example, floor installers may be on their knees almost an entire day. The use of a cushioning pad in conjunction with the work pants of a floor installer is an absolute requirement.

While prior art knee pad arrangements in conjunction with work pants generally perform in a satisfactory manner, many of the constructions of the prior art are bulky, uncomfortable, inconvenient to use and substantially detract from the appearance of the work pant. It is common in conjunction with work pants that a knee pad mounted within a knee pocket may tend to move in conjunction with the knee pocket during usage. In some prior art constructions, the knee pad can actually move sufficiently so as to be partially ejected from the knee pocket. This requires the user to be constantly readjusting the pad so that the knee pad is placed within its proper position within the knee pocket. It would be desirable to design some type of structure where the position of the cushioning pad within the knee pocket is maintained without any possibility of ejection or partial ejection of the cushioning pad from the knee pocket as the work pant and knee pad are being used.

SUMMARY OF THE INVENTION

A first basic embodiment of the present invention comprises a pair of pants where at least one pant leg of the pants includes a knee pocket. The knee pocket is defined as comprising a substantially a rectangularly shaped cavity that has a width that extends crosswise to the longitudinal dimension of the pant leg. An access opening is formed in the pant leg with the access opening providing access into the knee pocket. The access opening has a length which is shorter than the width of the knee pocket.

A further embodiment of this invention is where the first basic embodiment includes a releasable securement connected to the cushioning pad with this releasable securement also being mounted on the pant leg.

A further embodiment of this invention is where the releasable securement comprises a button and a strap.

A further embodiment of this invention is where the releasable securement comprises a buckle and a strap.

A further embodiment of this invention is where the pant leg in the area of the knee pocket is covered by a covering sheet with this covering sheet including a series of folds to allow for expansion when a user kneels on the knee pocket.

A second basic embodiment of the present invention comprises a pair of pants with the pants having at least one pant leg and the pant having a knee pocket. The knee pocket defining a substantially rectangular shaped cavity having a width substantially crosswise to the longitudinal dimension of the pant leg. An access opening is formed in the pant leg with the access opening providing access into the knee pocket. The access opening designed to connect with the cushioning pad which is to be inserted through the access opening to be located within the knee pocket. A releasable securement is connected to the cushioning pad with this releasable securement being mounted on the pant leg.

A further embodiment of this invention is where the second basic embodiment is modified so that the releasable securement comprises a button and a strap.

A further embodiment of this invention is where the second basic embodiment is modified to where the releasable securement includes a buckle and a strap.

A further embodiment of this invention is where there is placed on the work pant covering the knee pocket a covering sheet which includes a series of folds to allow for expansion when a user kneels.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
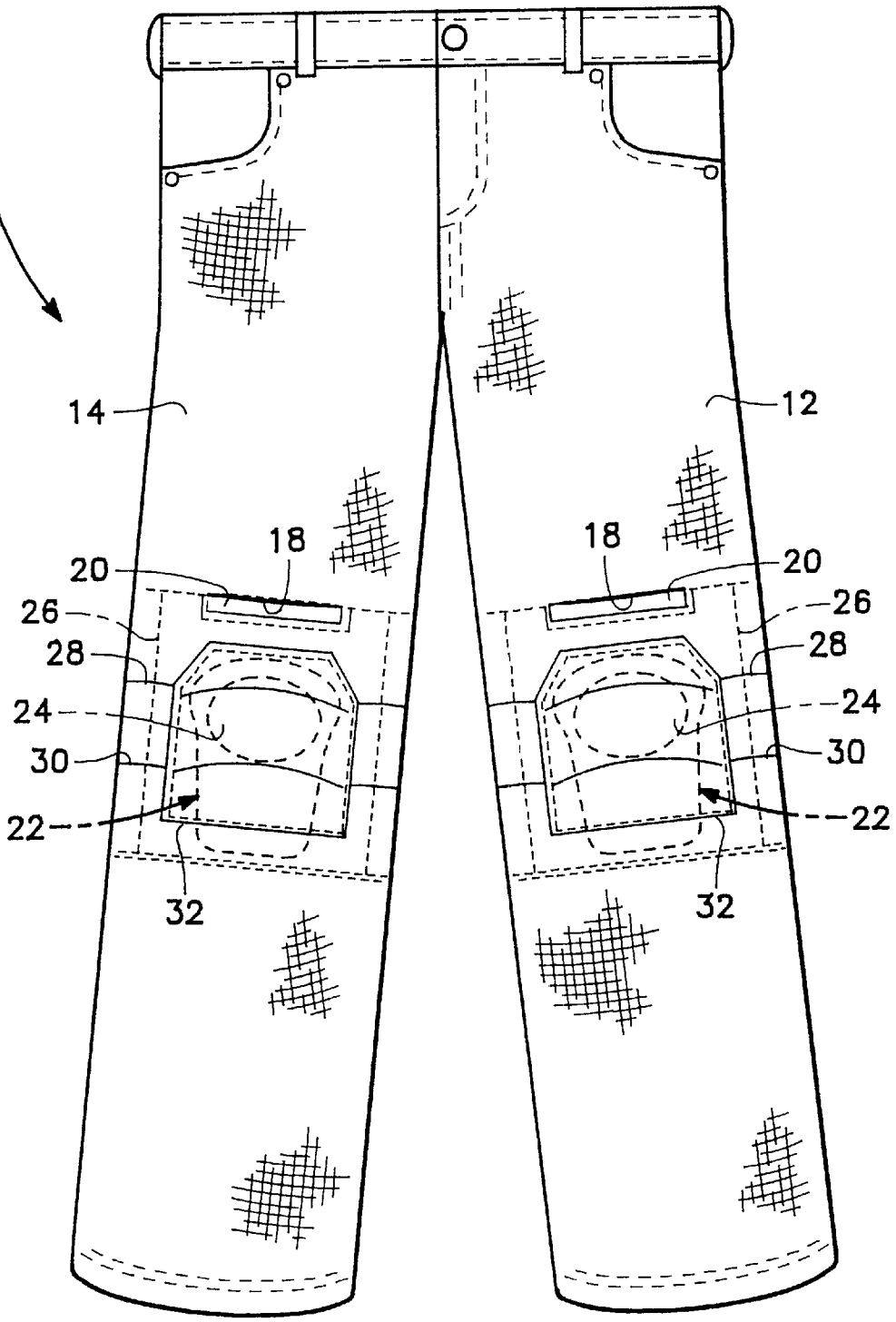
FIG. 1 is a front elevational view of a work pant which includes the knee pocket construction of the present invention.
Figure 2:
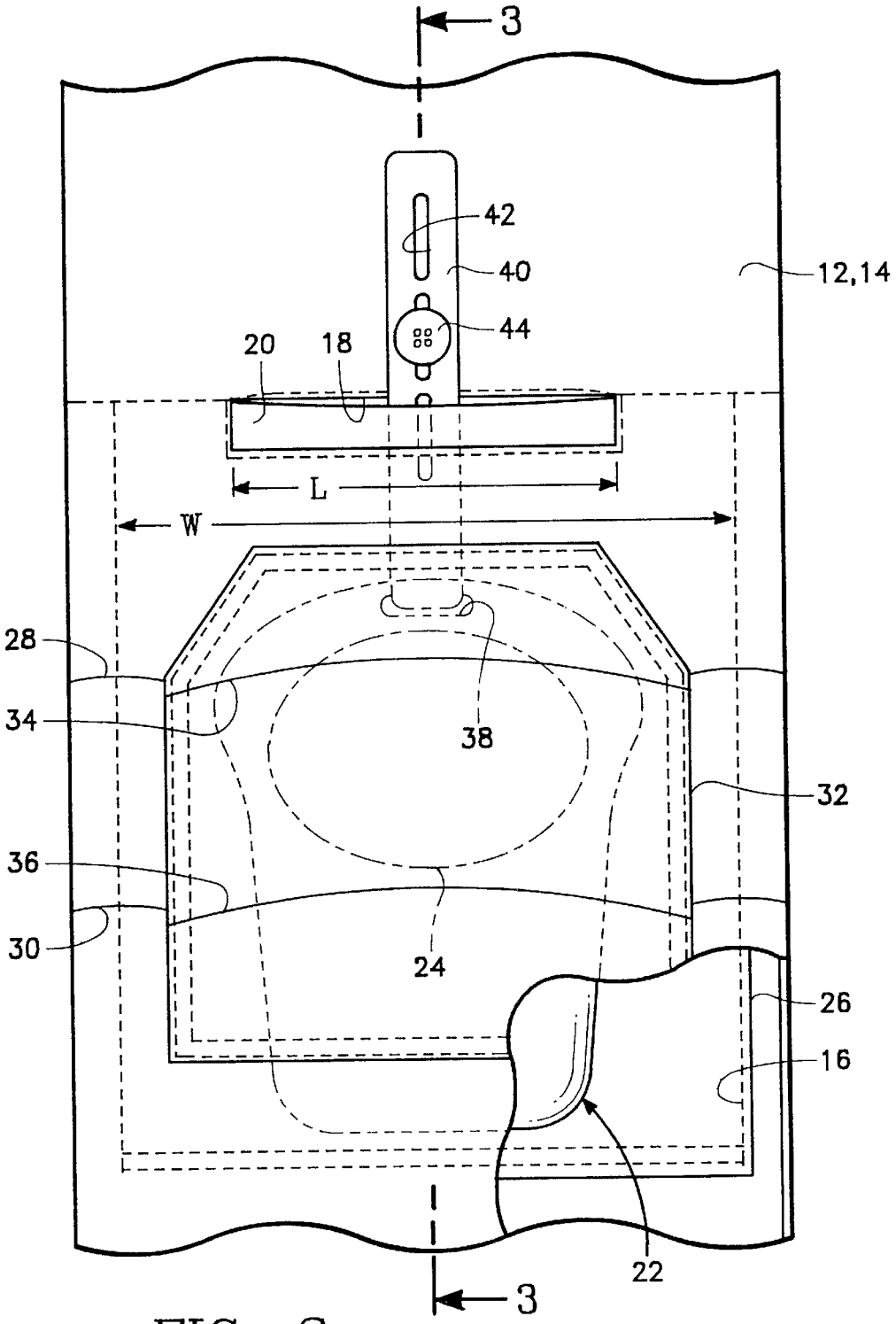
FIG. 2 is an enlarged front elevational view of a knee pocket constructed in accordance with this invention which shows the cushioning pad being connected to a strap which in turn is fixed by means of a button which is mounted on the work pant.
Figure 3:
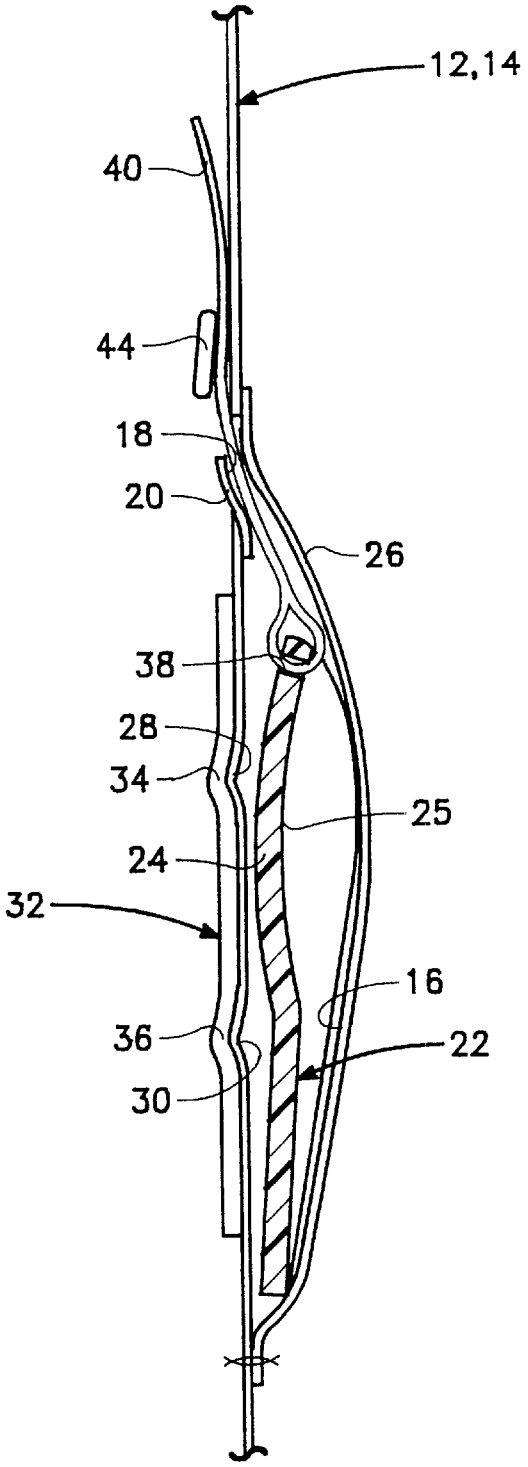
FIG. 3 is a longitudinal cross-sectional view taken along line 3—3 of FIG. 2.

Referring particularly to the drawings, there is shown in FIG. 1 a work pant 10 that is to be constructed of a strong fabric, such as denim. The work pant 10 includes a pant leg 12 and a pant leg 14. Each pant leg 12 and 14 includes a knee pocket 16. Knee pocket is formed by an inside section 26 that is sewn to the inside of the pant leg 12 or 14. Each knee pocket 16 is identical. The knee pocket 16 is basically rectangular in Aid configuration and has a width W. Access into the knee pocket is provided by means of an access opening 18. The access opening 18 is normally closed by means of a fabric flap 20. The fabric flap 20 is mounted on the denim material of the pant leg 12 or 14. The length L of the access opening 18 is clearly shown in FIG. 2 as being substantially less than the width W.

The cushioning pad 22 is to be constructed of a foam or other similar type of cushioning material. Cushioning pad 22 includes a bulbous section 24 which has an internal cavity 25. The user's knee is intended to fit within the internal cavity 25 which provides for an somewhat of an ergonomic fit in conjunction with the user's knee. It is to be understood that the user's leg is to be bent at substantially a ninety degree or greater angle with the knee coming to rest against a hard surface. The cushioning pad 22 is to provide a soft cushioning surface between the hard surface and the user's knee for reasons of comfort and to prevent injury.

The cushioning pad 22 can be folded over upon itself and be inserted through the access opening 18. Once within the knee pocket, the cushioning pad 22 is to be expanded and substantially fill the area defined by the knee pocket 16. As the user uses the knee pocket, there may be a tendency for the cushioning pad 22 to work upward toward the access opening 18 in such a case because the length L of the access opening 18 is less than the width W of the knee pocket 16, there is no way for the cushioning pad 22 to have a tendency to work outward through the access opening 18. Because the length L of the access opening 18 is shorter than the width W of the knee pocket 16, the cushioning pad 22 would be restrained and accidental ejectment from the knee pocket 16 would be prevented.

The pant leg 12 or 14 is to include folds 28 and 30 in the area of the knee pocket 16 which permits the fabric cover 26 to expand slightly when the user goes from a standing position to the kneeling position as the pant leg 12 or 14 will stretch. Additionally, it may be desirable to provide protection to the pant leg 12 or 14 to prevent holes being formed in the pant leg 12 or 14 due to the abrasive action of the work surface on which the user is kneeling. For that reason, there may be sewn on the pant leg 12 or 14 a covering sheet 32. The covering sheet 32 also includes similar folds 34 and 36. Typical material for the covering sheet would be leather. Also, plastic could be used.

It may be desirable to further restrain the cushioning pad 22 by applying some form of securement directly to the pad which connects to the pant leg 12 and 14. Therefore, referring to FIG. 2, the cushioning pad 22 includes a hole 38. Passing through the hole 38 is a strap 40. Typical material for the strap 40 would be a fabric or plastic. The strap 40 includes a plurality of spaced apart elongated slots 42. Fixedly mounted on the pant leg 12 and 14 would be a button 44. Button 44 is to connect with one of the elongated slots 42 with the strap 40 tending to prevent downward movement of the cushioning pad 22 within the knee pocket 16.

Figure 4:
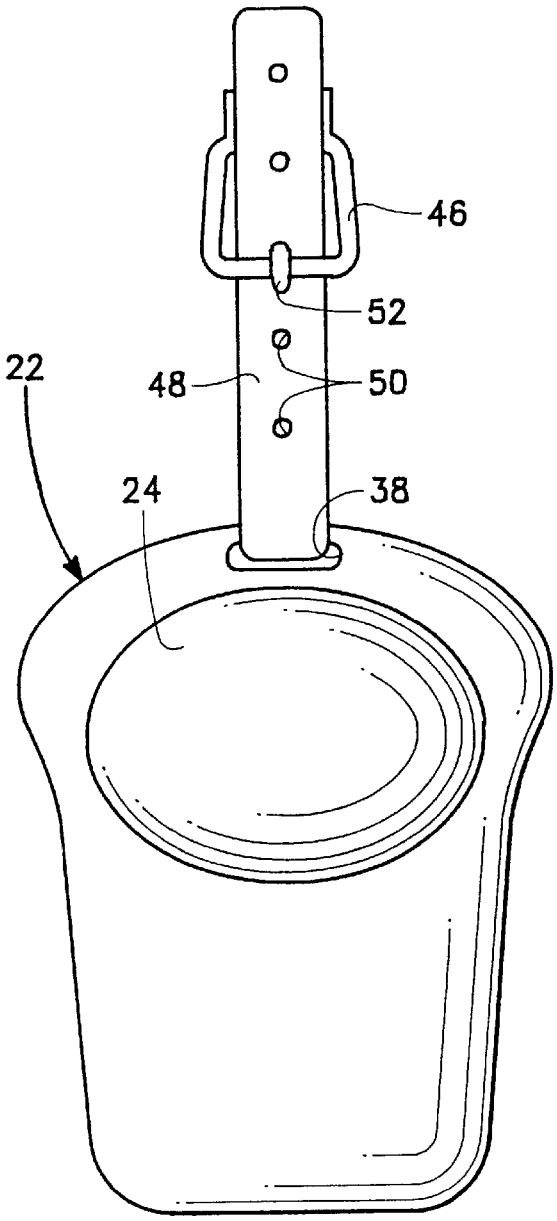
FIG. 4 is a front elevational view of a cushioning pad which is shown connected to a different type of securement which comprises a buckle and a strap.

Referring particularly to FIG. 4, instead of using the strap 40 and the button 44, there may be utilized a buckle 46 that may be fixedly mounted onto the pant leg 12 or 14. The buckle 46 would be used instead of the button 44. The buckle 46 is to be connectable with a strap 48 that is passable through the hole 38 of the cushioning pad 22. The strap 48 includes a series of spaced apart punch holes 50. A given punch hole is to connect with a tongue 52 of the buckle 46.

What is claimed is:

1. In combination with a pair of pants, said pants having at least one pant leg, said pant leg having a longitudinal direction, said pant leg having a knee pocket, said knee pocket defining a substantial rectangular shaped cavity having a width extending crosswise to said longitudinal dimension, the improvement comprising:

an access opening formed in said pant leg, said access opening providing access into said knee pocket, a cushioning pad in a folded configuration is insertable through said access opening to be expanded and confined by said pocket with accidental removal of said pad being prevented due to said access opening being smaller in length than said width of said knee pocket;

releasable securement means connected to said pad, said releasable securement means being mounted on said pant leg; and said releasable securement means comprising a buckle and a strap, said strap being mounted on said pad, said buckle being mounted on said pant leg, said strap to be securable by said buckle.

2. In combination with a pair of pants, said pants having at least one pant leg, said pant leg having a longitudinal direction, said pant leg having a knee pocket, said knee pocket defining a substantial rectangular shaped cavity having a width extending crosswise to said longitudinal dimension, the improvement comprising:

an access opening formed in said pant leg, said access opening providing access into said knee pocket, a cushioning pad in a folded configuration is insertable through said access opening to be expanded and confined by said pocket with accidental removal of said pad being prevented due to said access opening being smaller in length than said width of said knee pocket;

releasable securement means connected to said pad, said releasable securement means being mounted on said pant leg; and a covering sheet mounted on said pant leg directly adjacent said access opening, said covering sheet substantially covering said knee pocket, said covering sheet including a series of folds to allow for expansion when a user kneels.

* * * * *